US006054916A

United States Patent [19]

Hofsäss

[11] Patent Number: 6,054,916

[45] Date of Patent: Apr. 25, 2000

[54] SWITCH HAVING A TEMPERATURE-DEPENDENT SWITCHING MECHANISM

[76] Inventor: Marcel Hofsäss, Höfener Strasse 29, 75305, Neuenbürg, Germany

[21] Appl. No.: 09/104,966

[22] Filed: Jun. 25, 1998

[30] Foreign Application Priority Data

Jun. 27, 1997 [DE] Germany ..... 197 27 383

[51] Int. Cl.[7] ..... H01H 37/66

[52] U.S. Cl. ..... 337/344; 337/3; 337/333; 337/342; 337/380

[58] Field of Search ..... 337/3, 15, 16, 337/35, 36, 68, 75, 85, 333, 342–344, 365, 375, 377, 380, 384; 219/505, 511, 512; 335/90, 84, 31

[56] References Cited

U.S. PATENT DOCUMENTS

| | | | |
|---|---|---|---|
| 3,014,104 | 12/1961 | Cobine et al. . | |
| 3,656,073 | 4/1972 | Wood et al. | 335/179 |
| 4,039,993 | 8/1977 | Kerr | 337/366 |
| 4,306,211 | 12/1981 | Hofsass | 337/89 |
| 4,383,231 | 5/1983 | Yamanaka et al. | 335/146 |
| 4,470,033 | 9/1984 | Hofsass | 337/343 |
| 4,689,599 | 8/1987 | Calenda et al. . | |
| 4,822,959 | 4/1989 | Schwab | 200/5 A |
| 5,847,637 | 12/1998 | Takeda et al. | 337/344 |

FOREIGN PATENT DOCUMENTS

| | | | |
|---|---|---|---|
| 7521349 | 11/1975 | Germany . | |
| 2434071 | 1/1976 | Germany . | |
| 2121802 | 10/1988 | Germany . | |
| 3710672 | 10/1988 | Germany . | |
| 19636320 | 3/1997 | Germany . | |
| 09063440A | 3/1997 | Japan | H01H 37/54 |
| 1356575 | 6/1974 | United Kingdom . | |

*Primary Examiner*—Leo P. Picard
*Assistant Examiner*—Anatoly Vortmar
*Attorney, Agent, or Firm*—Harness, Dickey & Pierce, P.L.C.

[57] ABSTRACT

A switch has a housing which receives a temperature-dependent switching mechanism and comprises a lower part on whose inner bottom a first countercontact for the switching mechanism is arranged, and a cover part, closing off the lower part, on whose inner side a second countercontact for the switching mechanism is provided. The switching mechanism has an electrically conductive spring disk which carries a movable contact element and operates against a bimetallic snap disk which sits approximately centeredly on the movable contact element, the spring disk being braced at its rim against the countercontacts and pressing the movable contact element against the countercontact when the switching mechanism is below its response temperature. The countercontact against which the spring disk is braced at its rim below the response temperature is magnetic.

3 Claims, 2 Drawing Sheets

SWITCH HAVING A TEMPERATURE-DEPENDENT SWITCHING MECHANISM

BACKGROUND OF THE INVENTION

1. Field of the Invention

The present invention concerns a switch having a housing which receives a temperature-dependent switching mechanism and has a lower part on whose inner bottom a first countercontact for the switching mechanism is arranged, and comprises a cover part, closing off the lower part, on whose inner side a second countercontact for the switching mechanism is provided, the switching mechanism comprising an electrically conductive spring disk which carries a movable contact element and operates against a bimetallic snap disk which sits approximately centeredly on the movable contact element, the spring disk being braced at its rim against one countercontact and pressing the movable contact element against the other countercontact when the switching mechanism is below its response temperature.

2. Related Prior Art

A switch of this kind is known from DE 37 10 672 A1.

In the case of the known switch, the housing has a lower part produced from electrically conductive material and a cover part, closing off the lower part, that is produced from insulating material. Arranged in said housing is the switching mechanism, which comprises a spring disk which carries a movable contact element. The spring disk operates against a bimetallic snap disk which is slipped over the movable contact element. Below the switching temperature, the spring disk, which is braced against the bottom of the lower part, presses the movable contact element against a countercontact which is provided internally on the cover part and extends outward through the cover in the manner of a rivet. The bottom of the lower part serves as the further countercontact for the switching mechanism.

Since the spring disk itself is produced from electrically conductive material, below the response temperature of the switching mechanism it ensures a low-resistance electrically conductive connection between the countercontact on the cover part and the countercontact on the lower part, contact being made to the lower part from outside. If the temperature of the switching mechanism then rises, the bimetallic snap disk suddenly snaps over and pushes the movable contact element, against the force of the spring disk, away from the countercontact of the cover so that the electrical connection is interrupted.

Switches of this kind are commonly used for temperature monitoring of electrical devices. As long as the temperature of the electrical device does not exceed a predetermined response temperature, the switch, which for this purpose is connected in series with the load to be protected, remains closed. If the temperature of the load then rises impermissibly, the bimetallic snap disk snaps over and thus interrupts the flow of current to the load.

A disadvantage of the known switch is that it is relatively complex to manufacture. This is due principally to the fact that after manufacture of the cover part, the countercontact must then be attached to the cover part, and provision must simultaneously be made for an electrically conductive connection through the wall of the cover part to the outside. This is accomplished in the manner of a rivet which transitions, outside the cover, into a head onto which conductors, crimp terminals, etc. can be soldered. This assembly of the countercontact to the cover part is generally accomplished manually, and is thus very cost-intensive.

A further switch, in whose housing a temperature-dependent switching mechanism as described above is also arranged, is known from DE 21 21 802 A1. In this switch, the cover part and lower part are both cup-shaped and are produced from electrically conductive material. Crimp terminals are integrally shaped onto both the upper part and the lower part, the crimp terminal of the lower part extending outward through a corresponding cutout in the wall of the upper part. An insulating film is arranged between the upper part and the lower part in order to insulate the two housing parts electrically from one another.

The temperature-dependent switching mechanism makes contact on the one hand with the lower part via the spring disk, and on the other hand with the cover part via the movable contact element, so that an electrically conductive connection exists between the two crimp terminals as long as the temperature of the switching mechanism is below the response temperature. If the temperature of the switching mechanism rises, this electrical connection is interrupted in the manner described above.

With this switch as well, final assembly is very complex due to the insulation film that must be set in place, and can thus only be performed manually. This manual final assembly is not only wage-intensive, but also leads to assembly errors and thus to a higher rejection rate.

A further disadvantage of the two switches described so far is that for certain applications they must additionally be insulated externally, since current flow occurs through the electrically conductive lower part.

U.S. Pat. No. 4,490,704 discloses a further temperature-dependent switch which has a lower housing part made of insulating material and a cover made of metal which rests on a shoulder of the lower part and is retained by a rim of the lower part. The temperature-dependent switching mechanism comprises a bimetallic spring, clamped at one end, which at its free end holds a movable contact which, below the response temperature of the switching mechanism, is in contact with a fixed countercontact that is arranged internally on the cover.

At its other end the bimetallic spring is immovably clamped and connected to a resistor which runs along the bottom of the lower part. Provided in the bottom is a through hole into which a button-like connector element is inserted from below. This connector element is soldered, at its head projecting into the interior of the switch, to the resistor. The button-like head transitions into a clip which runs through laterally under the wall of the lower part and transitions into a connector lug next to the lower part.

This document therefore describes a completely different temperature-dependent switching mechanism from the two publications cited above, in which, because of the bimetallic spring clamped at one end, lesser demands are made in terms of insulation of the switching mechanism in the various switching states.

Making contact to the clamped end of the bimetallic spring is very laborious due to the button-like connector element: not only are parts of very complex shape necessary, but because the button-like head is soldered to the resistor in the interior of the lower part, assembly is very laborious. A further disadvantage of this switch is that is not insulated either at the top or at the bottom, so that particular precautionary measures are necessary when it is attached to a device being protected.

A further disadvantage with the two switches described at the outset arises from the fact, desirable in itself, that the bimetallic snap disk is not mechanically loaded and is placed, so to speak, unconstrainedly into the housing, so that mechanical loads cannot lead to a shifting of the switching temperature, as is the case with the switch, also discussed, having the bimetallic spring clamped at one end. However, when switches with bimetallic snap disks laid in loosely in this fashion are used in the vicinity of alternating magnetic fields, the bimetallic snap disk can be caused to vibrate since it can be magnetized by a magnetic field because of its composition. In other words, the bimetallic snap disk is magnetized by the external magnetic field and follows its oscillations.

Such vibrations of the bimetallic snap disk are, however, undesirable, since they mechanically stress it, which can lead to a shortening of service life and uncontrolled shifting of the switching temperature. In order to suppress such influences, temperature-dependent switches of the kind mentioned at the outset are therefore often equipped with a magnetic shielding plate; it is furthermore known to set in place a further stabilizing disk which retains the bimetallic snap disk in vibration-free fashion below its response temperature. This additional retaining of the bimetallic snap disk, however, on the one hand is structurally complex and on the other hand has the undesirable side effect that the bimetallic snap disk is in fact being loaded, which was precisely what loose placement is intended to prevent.

In this context it is known from DE 196 36 320 A1, in the case of a temperature-dependent switch having a spring tongue clamped at one end and a bimetallic strip set unconstrainedly in place, to produce a retaining or guidance element of the spring tongue and/or bimetallic strip from magnetic material. Here, in a manner known per se, the spring tongue carries a movable contact which is in contact with a fixed contact, such that the spring tongue (at its clamped-in ends) and the fixed contact are each connected to an external terminal. In the event of an impermissible rise in temperature, the bimetallic strip—which is set loosely in place but is guided at its narrow ends—lifts the movable contact away from the fixed contact.

The magnetized retaining or guidance element is located next to one of the two narrow sides of the bimetallic strip; an alternating magnetic attraction between the bimetallic strip and the retaining or guidance element is intended to prevent vibrations of the bimetallic strip.

With this switch as well, on the one hand its complex design is disadvantageous: here again, the mechanical clamping at the retained end of the spring tongue influences the switching temperature unpredictably. A further disadvantage with this switch is that the attractive force between the retaining and guidance element and the bimetallic strip is often not sufficient, since these two elements are in a geometrically very unfavorable position with respect to one another. The desired suppression of vibrations is therefore often not achieved with this switch.

SUMMARY OF THE INVENTION

In view of the above, it is an object of the present invention to improve the switch mentioned at the outset in such a way that vibrations of the bimetallic snap disk can be prevented by means of a simple design.

According to the invention this object is achieved, in the case of the switch mentioned at the outset, by the fact that the countercontact, against which the spring disk is braced at its rim below the response temperature, is magnetic.

The object underlying the invention is completely achieved in this fashion.

Specifically, the inventor of the present application has recognized that a much better attraction can be achieved between the bimetallic snap disk and a magnetic part of the switch if said magnetic part is arranged in planar fashion under the bimetallic snap disk. This arrangement is achieved, in surprisingly simple fashion, by expanding the function of the countercontact, which is present in any case, so that it is now "magnetic."

"Magnetic" for the purposes of this application is understood to mean both magnetizable materials and those with a high relative permeability, ferromagnetic materials, etc., and also permanent magnets. All that is important is that the material used to produce the countercontact which braces the spring disk in the inactive position can exert a magnetic attraction force on the bimetallic snap disk which lies above it with the spring disk interposed. Said countercontact now lies so close to the bimetallic snap disk that because of this geometrically very effective arrangement, even a small magnetization is sufficient to prevent vibrations of the bimetallic snap disk without subjecting it to excessive mechanical loads. One great advantage of the new switch is that it requires no modification at all in terms of design, and instead, a suitable material for the countercontact merely needs to be selected; said countercontact may possibly still need to be magnetized before or after assembly, so that at most, one additional production step is necessary.

It is not in fact inherently necessary to pre-magnetize the countercontact produced from magnetic material, since when the switch finds itself in an alternating magnetic field, magnetization of both the bimetallic snap disk and the countercontact thereby occurs automatically, so that the desired attractive effect is then achieved. On the other hand, however, it is desirable if the switch is delivered with the countercontact already magnetized, since then the bimetallic snap disk is held in noncontact fashion in its position, so that mechanical vibrations also cannot have a negative effect on the switching temperature or service life of the bimetallic snap disk.

It is preferred in this context if the lower part is produced from insulating material, if contact can be made to the first countercontact from outside through a wall of the lower part, and if the cover part is produced from electrically conductive material and simultaneously acts as the second countercontact, the cover part being retained on an upper rim of the lower part.

Since the lower part is now produced from insulating material, no insulating film is necessary in order to provide for suitable electrical insulation between the lower part and cover part. A further advantage is the fact that the cover part itself acts as the countercontact, so that the complex process of the prior art of making contact through the cover part is superfluous. This external contacting can be achieved much more easily in the case of the lower part by, for example, providing a slot in the wall of the lower part, through which a connector element of the first countercontact extends outward. The lower part can thus be produced as a cup having an elongated slot in its outer wall, and the first countercontact then simply needs to be set in place so that its outwardly projecting connector element lies in the slot. The bimetallic switching mechanism is then set in place, preferably in reverse sequence from what has hitherto been commonly known, and lastly follows the cover part, which is retained directly on the rim of the lower part, snap lugs, for example, being provided there. The entire assembly process for the new switch is therefore very simple, and in addition relatively few components are needed, so that because of its simple construction, costs for the new switch can be kept very low.

It is preferred in this context if the first countercontact is retained in lossproof fashion in the lower part by encapsulation or injection-embedding during manufacture of the lower part, in such a way that it is an integral component of the lower part.

The advantage here is that the lower part can now be produced, for example, as an injection-molded plastic part, the first countercontact being directly injection-embedded during the injection molding operation so that it becomes an integral component of the lower part. In other words, during said lower of said lower part, attachment of the countercontact to the bottom of the lower part is accomplished concurrently, so that several operations can be eliminated here. Moreover, the first countercontact is completely insulated externally by means of the injection embedding, so that subsequent insulation by means of epoxy or an insulating cap, as was hitherto known, is superfluous.

In an embodiment, it is preferred if the first countercontact has a shaped-on connector element projecting through a wall of the lower part.

The advantage here is that both assembly of the first countercontact to the lower part and provision of contacts to it outward through the wall can be accomplished integrally during production of the lower part, in one operation. The countercontacts with shaped-on connector elements can be delivered, for example, in belt-mounted fashion, whereupon an injection molding machine then injection-embeds one countercontact after another into the lower housing part. Then the bimetallic switching mechanism simply needs to be placed into said lower part, whereupon it is then closed off by the cover part which simultaneously acts as the second countercontact. The overall result is therefore very few production steps for complete manufacture of the new switch, so that the costs for said switch can be kept very low.

In a preferred embodiment, the first countercontact is in this context an electrically conductive ring or an electrically conductive disk, which is preferably configured integrally with the connector element. The second countercontact is preferably also configured integrally with the connector element.

These features are on the one hand advantageous in terms of design because disks and rings are particularly simple and economical to manufacture and can easily be encapsulated or injection-embedded, so that production of the lower part with the integral countercontact arranged therein can be accomplished very economically and simply. After production in this fashion, the connector element then automatically extends outward through a lateral wall of the lower part.

The configuration as a disk yields the further advantage of resulting in better thermal contact for the new switch, through the bottom of the lower part produced from insulating material to the device to be protected in terms of its temperature profile, than in the case of a ring.

If the first countercontact is, however, configured as a ring, the result is a large open region in its center made of insulating material, with which the movable contact element of the bimetallic switching mechanism can come into contact without resulting in electrical contact with the countercontact, so that in this case the insulating disk that might otherwise be necessary between the bimetallic switching mechanism and the cover part can be dispensed with.

If the first countercontact is configured as a disk because of the better heat transfer, then an insulating disk simply needs to be placed between the bimetallic snap disk and the cover part in order to prevent contact, in the high-temperature position, between the rim of the spring disk and the second countercontact, and thus prevent an undesired short circuit.

In an embodiment, however, it is preferred if the first countercontact has an approximately centered contact projection with which the movable contact element of the switching mechanism is in contact below its response temperature.

The advantage here is that the switching mechanism is, in a manner of speaking, placed "upside down" into the housing, so that below the response temperature, the spring disk is now braced with its rim against the cover part. One advantage of this arrangement lies in the simple assembly process, since now the bimetallic snap disk is placed first into the lower part, where it centers itself, if applicable, on the contact projection. The spring disk with welded-on contact element is then set in place, and also automatically centers itself in the opening of the bimetallic spring disk, so that the new switch can now be assembled automatically.

In an embodiment, the lower part now overlaps the first countercontact in annular fashion, thus constituting an insulating support region on the first countercontact.

The advantage here is that this insulating support region can be produced concurrently during injection molding or molding of the lower part, eliminating the need to use an additional insulating disk. If the switching mechanism is then installed "upside down" into the housing, then below the response temperature the spring disk is braced with its rim against the cover part, and presses the movable contact part against the contact projection. Above the contact temperature, the spring disk now rests with its rim on the insulating support region, so that although the center regions of the spring disk and the bimetallic snap disk are in contact against the cover part, a short circuit can no longer occur between the two countercontacts. This feature, of very simple design, thus once again considerably decreases the complexity involved in final assembly of the new switch. Quality and productivity are also enhanced thereby, since during the production process for known switches, the insulating cap and/or film is mechanically stressed, which can cause the formation of cracks which lead to short circuits. These problems do not occur with the new switch.

It should be particularly emphasized here that the number of operations is also drastically reduced, since after injection-embedding of the first countercontact, all that is necessary is to set the bimetallic snap disk and spring disk in place in the lower part, which then merely needs to be closed off with the cover part. These operations are now so simple that they can readily be automated.

The mechanical design of the new switch as described so far is the subject of German patent application 196 09 310 (not previously published). In the switches described there, however, the countercontacts are configured as stamped sheet-metal parts, i.e. are not magnetizable.

The inventor of the present application has now recognized that this mechanical design offers particular advantages in conjunction with the basic idea of this present invention, namely that of making the countercontacts magnetic. Depending on the orientation of the switching mechanism in the housing, either the countercontact injection-embedded into the bottom of the lower part produced from insulating material, or the cover part serving as countercontact, is manufactured from magnetic material and optionally magnetized after production, as was mentioned above. Both countercontacts lie very close to the bimetallic snap disk, so that even small magnetic forces are already sufficiently to immobilize the bimetallic disk in its rest position, i.e. protect it from mechanical vibrations or those induced by alternating magnetic fields. The cover part in particular can, moreover, also be easily magnetized later on, since it is directly accessible from outside, so that magnetizing coils can be brought very close to the cover part with no interference from interposed insulation layers, as would be the case for the countercontact provided in the lower part.

Further features and advantages are evident from the description and the appended drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

Embodiments of the invention are shown in the appended drawings and will be explained in more detail in the description below.

In the drawings.

DETAILED DESCRIPTION OF PREFERRED EMBODIMENTS

Figure 1:
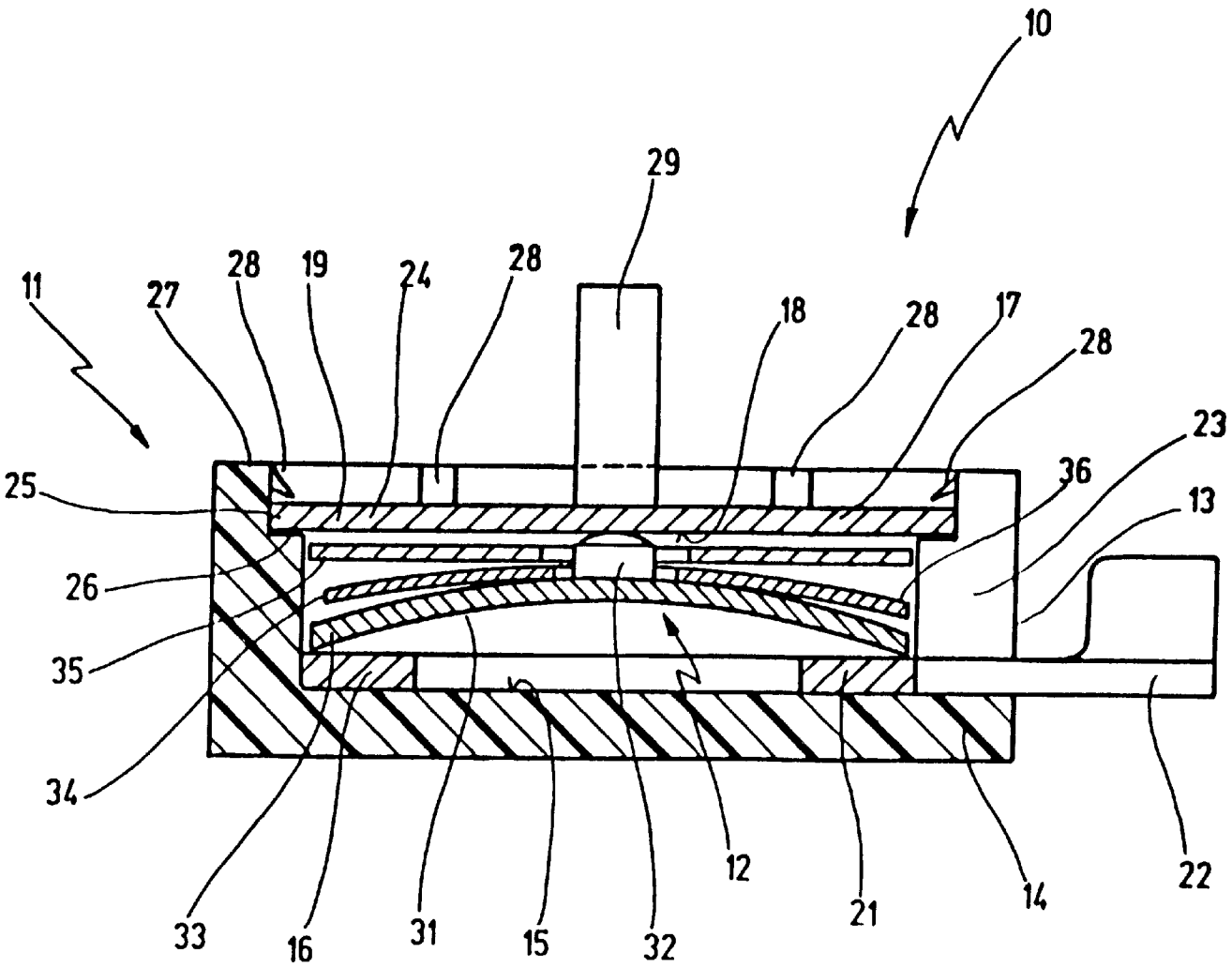
FIG. 1 shows the new switch in a first embodiment, in a schematic sectioned representation in a side view.

In FIG. 1, 10 indicates a switch in whose housing 11 a temperature-dependent switching mechanism 12 is arranged. Switches of this kind are used, for example, to monitor the temperature of electrically operated devices, and for that purpose are connected electrically in series with the device.

Housing 11 comprises a lower part 14, having a wall 13, on whose inner bottom 15 a first countercontact 16 for switching mechanism 12 is arranged. Lower part 14 is closed off by a cover part 17 on whose inner side 18 a second countercontact 19 is provided.

While lower part 14 is produced from electrically insulating material, cover part 17 is electrically conductive, so that it itself acts as the second countercontact.

First countercontact 16 is configured as a ring 21 whose connector element 22 extends outward through a slot 23 in wall 13. During assembly of switch 10, ring 21 is placed into the interior of lower part 14 in such a way that connector element 22 slides downward through slot 23. Said slot 23 can be very thin, so that it does not impair the function of the new switch. It is possible, however, to encapsulate or hot-stamp slot 23 after first countercontact 16 has been set in place.

Second countercontact 19 is configured as disk 24 which is braced with its rim 25 on an inner peripheral shoulder 26 of lower part 14. A rim 27 of lower part 14 projects beyond rim 25 of disk 24. Snap lugs 28 which retain disk 24 in lossproof fashion on shoulder 26 are provided on said rim 27.

It is also evident from FIG. 1 that a connector element 29 of second countercontact 19 extends upward inside rim 27, where contact can be made to it in suitable fashion.

Switching mechanism 12 comprises a spring disk 31 which carries a movable contact element 32 that, in the embodiment shown, is welded onto spring disk 31. Spring disk 31 is braced with its rim 33 on ring 21 and, in the low-temperature position shown in FIG. 1, presses movable contact element 32 against disk 24 so that globally, an electrical connection is created between connector elements 22 and 29 via the electrically conducting spring disk 31.

A bimetallic snap disk 34 and an insulating disk 35 are slipped over movable contact element 32.

If the temperature of switch 10 then rises above the response temperature of switching mechanism 12, bimetallic snap disk 34 suddenly snaps over and is now braced with its rim 36, via insulating disk 35, against inner side 18 of cover part 17. In the process, the bimetallic snap disk pushes movable contact element 32, against the force of spring disk 31, away from disk 24 which constitutes the second countercontact. In this fashion, the electrical connection between the two connector elements 22 and 29 is interrupted.

During assembly of the switch shown in FIG. 1, first contact part 16 is first placed into lower part 14, and then spring disk 31, bimetallic snap disk 34, and insulating disk 35 are set in place. Then cover part 17 is placed into rim 27 of lower part 14 and pushed down until snap lugs 28 engage over disk 24 and retain it in lossproof fashion, i.e. "snap in."

Figure 2:
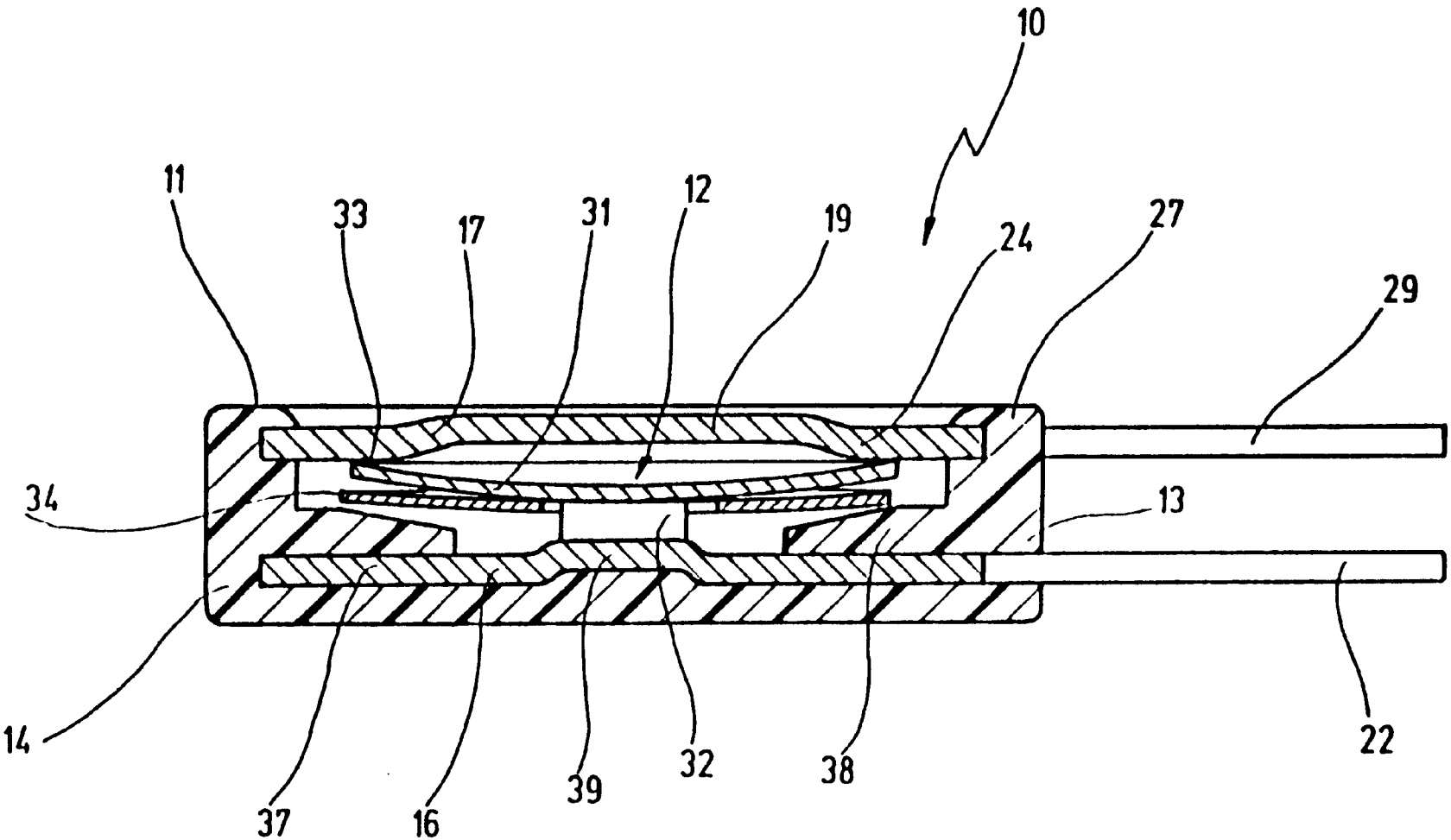
FIG. 2 shows a second embodiment of the new switch in a representation like that of FIG. 1.

FIG. 2 shows a further embodiment of the new switch 10 in which the first countercontact is also configured as a disk 37. Disk 37 is overlapped annularly at its rims by lower housing part 14, thus resulting in an insulating support region 38 which also insulates disk 37 at its rim toward the top.

Disk 37 additionally has, approximately centeredly, a contact projection 39 which points into the interior of housing 11.

In the embodiment of FIG. 1, countercontact 16 is then injection-embedded or encapsulated during the production of lower part 14, so that it is an integral component of lower part 14.

The bimetallic switching mechanism is set in place "upside down" in FIG. 2 as compared with FIG. 1, so that in the low-temperature position shown in FIG. 2, movable contact element 32 is in contact with contact projection 39. Spring disk 31 is braced with its rim 33 internally against cover part 17, so that a conductive connection is created between connector elements 22, 29 which both extend laterally through wall 13 of lower part 14.

In this context, connector element 29 lies in a cutout (not visible in FIG. 2) in rim 27, so that it can be set in place later on from above. It is evident that rim 27 overlaps disk 24 at its rim, and thus retains it in lossproof fashion. This attachment is achieved by that the fact that after disk 24 is set in place, a rim 27 which originally stood directly vertically is hot-stamped or hot-welded so that it at least partially overlaps disk 24. If rim 27 is correspondingly elevated, it is also possible to provide sufficient insulating material for disk 24 also to be insulated externally when rim 27 is hot-stamped.

In other words, this type of assembly process creates a switch that is completely insulated from the outside, from which only the two connector elements 22 and 29 still project. Good thermal contact with the outside is nevertheless still possible because both countercontacts 16 and 19 are configured as disks 37 and 24, respectively.

As a result of insulating support region 39, insulating disk 35 that is shown in FIG. 1 can be omitted from switch 10 as shown in FIG. 2. The reason is that now, when switching mechanism 12 is heated sufficiently for bimetallic snap disk 34 to kick over into its high-temperature position, it then braces against insulating support region 38 and pushes movable contact element 32 away from contact projection 39, until finally spring disk 31 also kicks over from the concave shape shown into a convex shape. Spring disk 31 and bimetallic snap disk 34 are now braced with their rims on insulating support region 38, so that any contact which may possibly occur against cover part 17 in the region of movable contact element 32 does not lead to an undesired short circuit between the two connector elements 22 and 29.

According to the invention, the countercontact on which spring disk 31 is braced below the response temperature of bimetallic snap disk 34 is produced from magnetized or magnetizable material having a high magnetic permeability, and is magnetized, if applicable, after switch 10 is assembled. Thus countercontact 16 in the case of the embodiment of FIG. 1, and countercontact 19 (i.e. cover part 17 itself) in the case of the embodiment of FIG. 2, is magnetic. Cover part 17 which is thus magnetized, or magnetic ring 21, now attracts bimetallic snap disk 34 which is also magnetic, so that the latter is not caused to vibrate in alternating magnetic fields or even in the presence of other mechanical oscillations. Subsequent magnetization is particularly easy in the case of the embodiment as shown in FIG. 2, since there countercontact 19 which is to be magnetized, in the form of cover part 17, is also easily accessible to magnetizing coils from outside.

What is claimed is:

1. A switch, comprising:

a temperature-dependent switching mechanism comprising an electrically conductive spring disk which carries a movable contact element and operates against a bimetallic snap disk which sits approximately centeredly on the movable contact element;

a housing for containing said temperature-dependent switching mechanism and including a lower part and an upper part closing off said lower part;

said lower part having a first countercontact on its inner bottom and said upper part having a second countercontact on its inner side;

the spring disk being braced at its rim against one of the countercontacts and pressing the movable contact element against the other countercontact when the switching mechanism is below its response temperature;

wherein the countercontact against which the spring disk is braced at its rim below the response temperature is magnetic; and wherein the first countercontact is configured as an electrically conductive ring.

2. A switch as in claim 1, wherein the first countercontact is configured integrally with the connector element.

3. A switch, comprising:

a temperature-dependent switching mechanism comprising an electrically conductive spring disk which carries a movable contact element and operates against a bimetallic snap disk which sits approximately centeredly on the movable contact element;

a housing for containing said temperature-dependent switching mechanism and including a lower part and an upper part closing off said lower part;

said lower part having a first countercontact on its inner bottom and said upper part having a second countercontact on its inner side;

the spring disk being braced at its rim against one of the countercontacts and pressing the movable contact element against the other countercontact when the switching mechanism is below its response temperature;

wherein the countercontact against which the spring disk is braced at its rim below the response temperature is magnetic; and wherein the lower part overlaps the first countercontact in annular fashion, thus constituting an insulating support region on the first countercontact.

* * * * *